US009167326B2

(12) United States Patent
Hardiman et al.

(10) Patent No.: US 9,167,326 B2
(45) Date of Patent: Oct. 20, 2015

(54) IN-WALL MULTIPLE-BAY LOUDSPEAKER SYSTEM

(71) Applicant: Core Brands, LLC, Petaluma, CA (US)

(72) Inventors: James M. Hardiman, Petaluma, CA (US); Michael L. Strange, Petaluma, CA (US); Doug S. Wright, Coeur d'Alene, ID (US)

(73) Assignee: Core Brands, LLC, Petaluma, CA (US)

( * ) Notice: Subject to any disclaimer, the term of this patent is extended or adjusted under 35 U.S.C. 154(b) by 152 days.

(21) Appl. No.: 14/087,945

(22) Filed: Nov. 22, 2013

(65) Prior Publication Data

US 2014/0233778 A1 Aug. 21, 2014

Related U.S. Application Data

(60) Provisional application No. 61/767,623, filed on Feb. 21, 2013.

(51) Int. Cl.

| | |
|---|---|
| ***H04R 1/02*** | (2006.01) |
| ***H04R 9/06*** | (2006.01) |
| *H04R 1/40* | (2006.01) |

(52) U.S. Cl.

CPC ..... *H04R 1/025* (2013.01); *H04R 1/403* (2013.01); *H04R 2201/021* (2013.01); *H04R 2499/15* (2013.01)

(58) Field of Classification Search

CPC .... H04R 1/025; H04R 2499/15; H04R 1/403; H04R 2201/021

USPC ..... 381/333, 386, 87, 332, 150, 152

See application file for complete search history.

(56) References Cited

U.S. PATENT DOCUMENTS

| | | | | |
|---|---|---|---|---|
| 4,296,280 | A | 10/1981 | Richie | |
| 6,360,842 | B1 | 3/2002 | Combest | |
| 7,720,247 | B2 | 5/2010 | Castro et al. | |
| 7,881,488 | B2 | 2/2011 | Holmi | |
| 8,605,936 | B2 * | 12/2013 | Proni | 381/386 |
| 2003/0123679 | A1 | 7/2003 | Dudleston et al. | |

* cited by examiner

*Primary Examiner* — Paul S Kim

(74) *Attorney, Agent, or Firm* — Schwegman Lundberg & Woessner, P.A.

(57) ABSTRACT

A modular sound component system can be configured to be located at least partially behind a wall surface, wherein the wall surface is supported by multiple vertical studs. The modular system can include a rail system that is in contact with the wall surface and at least one sound reproduction module coupled to the rail system. The sound reproduction module can include a body that can be disposed on a stud-side of the wall surface, and the module can include an attachment feature that is slidably coupleable to the rail system. In an example, the sound reproduction module can include a loudspeaker assembly, an amplifier assembly, or other device. Multiple modules can be slidably coupled to the rail system, such as on different sides of a wall stud. A wired communication link can couple the multiple modules, such as across a wall surface-side of the wall stud.

20 Claims, 10 Drawing Sheets

IN-WALL MULTIPLE-BAY LOUDSPEAKER SYSTEM

CLAIM OF PRIORITY

This patent application claims the benefit of priority, under 35 U.S.C. Section 119(e), to U.S. Provisional Patent Application Ser. No. 61/767,623, filed on Feb. 21, 2013, which is hereby incorporated by reference herein in its entirety.

BACKGROUND

Sound reproduction devices can be installed or placed in residential or commercial areas, such as in homes, offices, restaurants, or other areas. In some examples, a sound reproduction device can include a loudspeaker that can be installed on or against a wall.

High fidelity loudspeaker systems can be configured with a loudspeaker cabinet, or cavity, such as having a sufficient volume to accurately reproduce low frequency sounds. A challenge that faces acoustic designers can include minimizing a loudspeaker profile, such as to achieve an aesthetically-pleasing, low profile design, while maintaining a sufficient volume to provide accurate low frequency sound reproduction that is satisfying to a listener. This challenge is apparent throughout the sound reproduction market, and in particular in the integrated sound systems used with flat panel displays. Flat panel displays have increasingly diminishing profiles. Often, a flat panel display can include an integrated speaker system, such as having a small or thin profile that is commensurate with an overall thinness of the display profile. Such speaker systems having small or thin profiles can have correspondingly small cabinet volumes, and listeners can be dissatisfied with the sound output from such systems.

Some users turn to external sound reproduction systems to provide higher quality sound than is available from a display's integrated system. In an example, an external sound reproduction system can include a soundbar. A soundbar can include one or more drivers or loudspeakers arranged in an aesthetically pleasing, elongate, or in-line package. The elongate package can be mounted to a wall, or can be placed on a floor or table. In an example, the soundbar can have a sufficient volume to provide higher fidelity sound, such as relative to a display's integrated sound system. In an example, listeners or observers of a soundbar can perceive a soundbar as having a pleasing, diminutive profile because the elongate nature of the soundbar distributes its volume along a length. Some listeners or observers can prefer the diminutive profile of a soundbar over more bulky desktop or wall-mounted sound reproduction solutions.

OVERVIEW

A modular sound component system can be configured to be located at least partially behind a wall surface. In an example, the wall surface can be supported by multiple, spaced-apart vertical studs, and the components of the modular system can be disposed in one or more spaces between the spaced-apart studs. The modular system can include a rail system that can be in contact with the wall surface. The rail system can be configured to be coupled with at least one sound reproduction module. The sound reproduction module can include a module body portion that can be disposed on a stud-side of the wall surface, and the module can include an attachment feature that can be slidably coupleable to the rail system. In an example, the sound reproduction module can include a loudspeaker assembly, an amplifier assembly, or other device. Multiple modules can be slidably coupled to the rail system, such as on different sides of a wall stud.

A wired communication link can couple the multiple modules, such as across a wall surface-side of the wall stud. For example, the wired communication link can extend around a stud portion of the wall such that modification of the stud is not required in order to communicatively couple the modules.

For many homeowners or retailers, cutting a hole in a wall surface, or cutting or reconstructing internal studs, can be an undesirable consequence of using an in-wall sound reproduction system. In addition, professional installers tend to gravitate toward products that can be installed without structural modification, such as without stud modification. Structural modification, such as removal of a stud or a portion of a stud, can require construction of a header, or a doubling up on a header's support studs, which in turn can require removing or replacing a significant amount of a wall's surface (e.g., drywall surface).

The present inventors have recognized that a problem to be solved can include providing an easy-to-install in-wall loudspeaker system, such as without structural modification of the wall. The present inventors have further recognized that a problem to be solved can include providing an in-wall loudspeaker system that can have a low profile, yet can provide sound quality that is satisfying to listeners. The present subject matter can provide a solution to these problems and others, such as by providing a sound reproduction system having one or more components configured to be installed in a wall cavity or bay between wall studs. The sound reproduction system can be configured to have a room-side appearance that is appealing to users, such as a front face that is flush mount or substantially co-planar with a vertical wall surface. The sound reproduction system can effectively disappear in a room, and the system can be configured to use in-wall spaces to provide receptacle areas for loudspeaker cabinets or other sound reproduction components.

In an example, the sound reproduction system can include a customizable, modular system. The modules comprising the system can be selected to provide multiple different sound channels from a single, horizontally oriented and vertically minimized system. Methods disclosed herein can be used to provide a multi-channel loudspeaker system that is substantially flush with a wall's room-side surface. The system can be adjustably centered, such as relative to a nearby flat panel display, such as can be positioned above or below the in-wall loudspeaker system.

This Overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

An in-wall, multiple-bay loudspeaker system can be configured to provide high fidelity sound reproduction and can have an unobtrusive appearance in a room. In an example, the loudspeaker system can include one or more modules that can be selectively positioned in different configurations to customize the loudspeaker system.

In an example, the loudspeaker system can have a substantially flat surface appearance that can be aligned to be substantially co-planar with a wall surface, such as a vertical wall surface. The system surface can provide an aesthetically pleasing installed appearance, such as when used alongside a flat panel display. The loudspeaker system can be installed without structural modification of a wall, for example, without moving or cutting any vertical studs that support the wall surface.

In an example, the loudspeaker system can be configured to use one or more modules that can be positioned at least partially inside of a wall cavity or bay. A wall cavity or bay can include a void area behind a wall surface, such as between two or more structural supports or studs. The one or more modules in the loudspeaker system can include, among others, a loudspeaker module including a loudspeaker driver, an amplifier module, a filter module, or a control module. In an example, the loudspeaker system can include a multi-channel amplifier module, such as including a digital signal processor, configured to drive multiple loudspeaker drivers. In an example, the multiple loudspeaker drivers can be provided in a midwoofer-tweeter-midwoofer configuration (MTM, or D'Appolito array configuration).

Figure 1A:
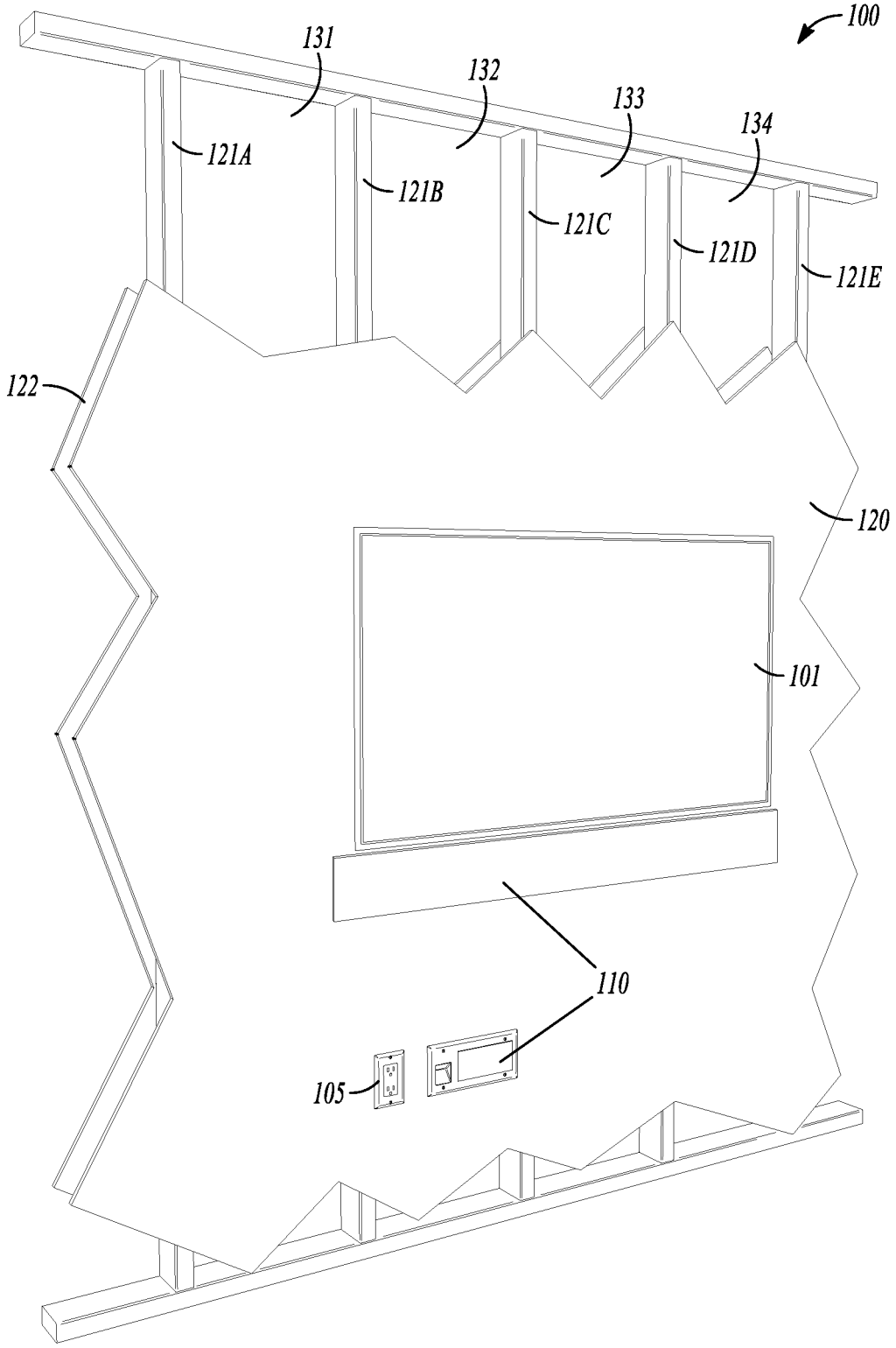
FIG. 1A illustrates generally an example that can include an entertainment system installed at least partially in or against a wall.

FIG. 1A illustrates generally an example of an entertainment system 100 that can include a flat panel display 101 and a loudspeaker system 110. The entertainment system 100 can be installed on or against a first wall surface 120. In an example, the flat panel display 101 can be mounted such that the display surface is substantially parallel to the first wall surface 120. In an example, the flat panel display 101 can be mounted on an arm (not shown) such that the display surface can be rotated or pivoted away from the first wall surface 120.

In an example, the first wall surface 120 can include a drywall, sheetrock, or other wall surface material. The portion of the first wall surface 120 illustrated in the example of FIG. 1A can be supported by multiple substantially vertical studs 121A, 121B, 121C, 121D, and 121E. The multiple substantially vertical studs can be spaced apart, such as by about 12 or 16 inches, or at other regular or irregular spacing intervals. In an example, a second or rear wall surface 122 can be installed opposite the first wall surface, such as against an opposite side of the same vertical studs 121A, 121B, 121C, 121D, and 121E.

A wall cavity, or unoccupied area, can be located between adjacent vertical studs, and can be enclosed by interior sides of the wall surfaces. For example, a first cavity 131 can be bounded by the first stud 121A, the second stud 121B, and the first and second wall surfaces 120 and 122. A second cavity 132 can be bounded by the second stud 121B, the third stud 121C, and the first and second wall surfaces 120 and 122, and so forth to define multiple cavities along the wall.

The loudspeaker system 110 can include one or more loudspeaker modules, or other modules, mounted to a frame. In an example, the frame can be mounted to one or more of the vertical studs 121A-121E, such as to span one or more of the wall cavities 131-134. The example of the loudspeaker system 110 can span three wall cavities, however, the system can be made to span any number of wall cavities.

In an example, a loudspeaker module in the loudspeaker system 110 can include a module face, a loudspeaker transducer, or driver, and a loudspeaker cabinet. The loudspeaker system 110 can optionally include a loudspeaker amplifier module, such as including a module face, and an amplifier circuit, including one or more electrical terminals for coupling to one or more loudspeaker modules. In an example, one or more portions of a loudspeaker module or amplifier module can be positioned or installed on a stud-side of the first wall surface 120. A speaker grille, screen, or other finishing surface can be positioned in front of the modules to provide a uniform room-side appearance.

In an example, the loudspeaker system 110 can include a power module, such as spaced apart from the frame. The power module can be configured to receive an AC mains power signal and provide a conditioned or converted power signal to a loudspeaker amplifier module or other module. In an example, the power module can be positioned near an AC outlet 105, such as shown in the example of FIG. 1A.

Figure 1B:
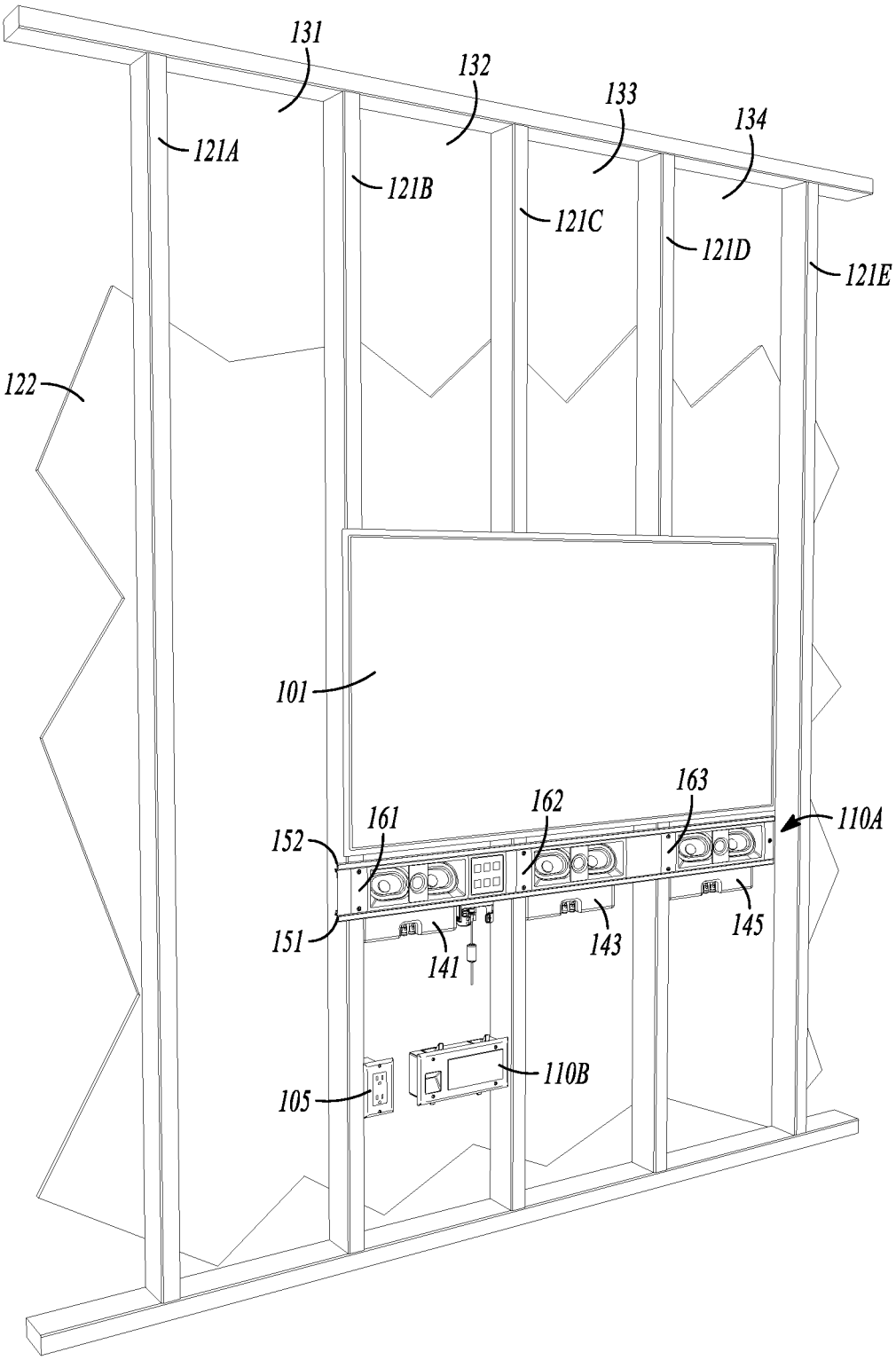
FIG. 1B illustrates generally an example that can include a cut-away view of an entertainment system having one or more components installed in a wall cavity.

FIG. 1B illustrates generally the entertainment system 100 without the first wall surface 120 and without the speaker grille, such that the system's frame and multiple modules are visible. In the example of FIG. 1B, the entertainment system 100 can include a frame-mounted portion 110A and power module 110B. The frame-mounted portion 110A can include first and second rails 151 and 152, and a first loudspeaker module 141, an amplifier module 170, a second loudspeaker module 142, and a third loudspeaker module 143. The rail system can provide an interface between one or more modules and the wall's structural (studs) and cosmetic (drywall) elements. In an example, a rail system can include one or more rails, such as the first and second rails 151 and 152, such as can include extruded, die-cast, or injection-molded rails. In an example, a rail can include a peripheral or edge portion that can have a contoured flange, such as further described below in the example of FIGS. 3A and 3B.

In an example, the power module 110B can include, among other features, a high voltage interface, a power converter circuit, or a low voltage interface. In an example, the high voltage interface can be configured to be coupled with the AC outlet 105, such as to receive a 110 or 220 V AC power signal. The high voltage interface can be coupled with the AC outlet 105 using a removable external power cord (not shown), or it can be internally wired to a power source. The power converter circuit can condition the received power signal, such as by converting the received AC power signal to a DC power signal. The power converter circuit can distribute the DC power signal to one or more modules in the loudspeaker system 110.

In an example, the power converter circuit can receive a 110 V AC power signal and provide a 24 V DC power signal to a loudspeaker amplifier module. In an example, the power module 110B can be installed against the first wall surface 120. At least a portion of the power module 110B can be disposed in a common wall cavity with one or more modules coupled to the frame-mounted portion 110A of the entertainment system 100. Low voltage wires can be provided to couple the power module 110B with the one or more modules.

Figure 2:
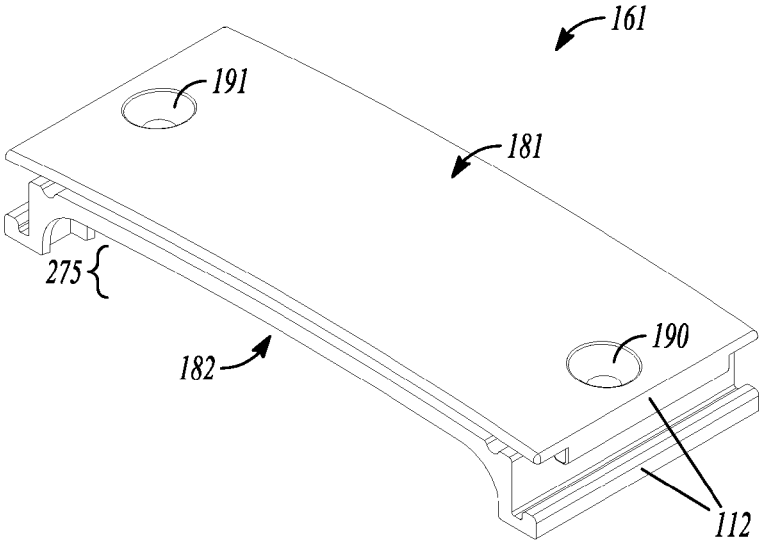
FIG. 2 illustrates generally an example that can include a stud mounting bracket.

In the example of FIG. 1B, the frame-mounted portion 110A of the entertainment system 100 can be coupled or mounted to the second, third, or fourth studs 121B, 121C, and 121D, such as using first, second, and third brackets 161, 162, and 163, respectively. FIG. 2 illustrates generally an example of the first bracket 161. The first bracket 161 can have a flange 112 configured to slidably engage with at least one of the first and second rails 151 and 152.

In an example, the first bracket 161 can include an outer surface side 181 configured to face an interior of a room when the first bracket 161 is coupled to a rail, and a stud-side surface 182 configured to face a stud. When the first bracket 161 is secured against a stud, a gap 275 or passage can be provided between at least a portion of the stud-side surface 182 of the first bracket 161 and the stud.

A bracket can be affixed to a stud, for example using one or a plurality of fasteners, such as using a threaded fastener or screw. The bracket 161 can include one or more fastener holes 190, 191 that can be configured to receive or retain the fastener. When installed against or with a stud, a bracket can provide support for one or more rails that can in turn be used to secure or support one or more modules in the frame-mounted portion 110A of the entertainment system 100. That is, a bracket can provide a mechanical interface between a module (e.g., a loudspeaker module, amplifier module, power supply module, interface module, etc.) and a wall's structural elements, such as via a rail.

In an example, a bracket (e.g., any of the first, second, or third brackets 161, 162, or 163) can be configured to provide or maintain a separation distance (e.g., a vertical separation distance) between the first and second rails 151 and 152. A bracket can have first and second dimensions, such as a vertical dimension and a horizontal dimension relative to a wall surface when the bracket is installed. In an example, the horizontal dimension can be sufficiently sized to accommodate a fastener and at least a portion of a wall stud, for example, the horizontal dimension can be about 1.5 inches. The vertical dimension can be selected according to a size or type of module selected to be used with the loudspeaker system 110.

In an example, modules can be provided with different vertical dimensions (corresponding to different module face heights), such as to provide differently sized loudspeaker drivers or related components. In an example, a low-profile loudspeaker module can include a 2.5 inch driver, and the module can have an overall vertical dimension of about three inches. The low-profile module can be used with a corresponding bracket having a vertical dimension of about three inches. Other modules can have larger profiles, such as having a vertical dimension of six inches or more, and can be used with corresponding brackets having a vertical dimension of six inches or more to appropriately space the rail system.

A type of bracket can include a spacer, such as can be similarly constructed to the first bracket 161, for example without the one or more fastener holes 190, 191. Such spacers can be selected to cover voids in the frame-mounted portion 110A of the entertainment system 100 to cover otherwise unoccupied or open spaces between modules. For example, a spacer can be provided to cover an open space in a rail system between a loudspeaker module (e.g., positioned adjacent to a first stud) and an amplifier module (e.g., positioned adjacent to a nearby second stud). In an example, a spacer can be slidably coupled with one or more rails, such as described above in the example of the first bracket 161 and the first and second rails 151 and 152. In an example, a spacer can be cut from a macro spacer. The macro spacer can be provided in a sheet-like form such that a user can cut a functional spacer having a user-specified width to accommodate the user's particular installation configuration.

In the example of FIG. 1B, the first, second, or third loudspeaker modules 141, 142, 143 can be attached to the frame and positioned at least partially in the second, third, and fourth wall cavities 132, 133, and 134, respectively. The first, second, or third loudspeaker modules 141, 142, and 143 can be selectively removed from the frame, such as to change the system configuration. In an example, a communication link, such as a wired connection, can be provided between the first and second loudspeaker modules 141 and 142. The communication link can include one or more electrical conductors that can extend over the wall-side surface of the third stud 121C. For example, the wired connection can extend from the second wall cavity 132 to the third wall cavity 133, such as without passing through the third stud 121C, and instead passing around the third stud 121C. The wired connection can pass over a location where drywall, plaster, or another material would otherwise be positioned in the absence of the loudspeaker system. In an example, the wired connection can be established using, among others, an optical cable, a stereo or mono 3.5 mm cable, an RCA cable, or HDMI cable.

The second bracket 162 can include an outer surface side configured to face an interior of a room, and a stud-side surface, configured to face the third stud 121C. A gap or passage can be provided between at least a portion of the stud-side surface of the second bracket 162 and the third stud 121C. The wired connection between the first and second loudspeaker modules 141 and 142 can pass through the gap between the wall-side surface of the third stud 121C and the stud-side surface of the second bracket 162.

Various types of modules can be included in the entertainment system 100. For example, additionally or alternatively to a loudspeaker module, a module can include an infrared (IR) transceiver that can be configured to receive or transmit an IR signal. In an example, information from a received IR signal can be used to adjust one or more functions of the entertainment system 100. For example, the received IR signal can be used to adjust a parameter of a loudspeaker amplifier module, such as to increase or decrease a system volume, to enable or disable a specified loudspeaker channel, or to update a crossover frequency, among other adjustable functions. In an example, a module can include a wireless transmitter that can be configured to provide an audio signal to a nearby powered subwoofer system.

FIG. 1B illustrates generally an example of the frame-mounted portion 110A, such as including the first and second rails 151 and 152. In an example, the frame-mounted portion 110A can include a single rail, and one or more modules can be configured to couple with the single rail. For example, the frame-mounted portion 110A can include an upper rail, such as the second rail 152, and a loudspeaker module (e.g., the first loudspeaker module 141) can be configured to slidably couple with the second rail 152. In an example, a module configured to be mounted on a single rail can include a wall surface retention or coupling feature, such as opposite an attachment feature used to couple the module to the single rail. The wall surface retention or coupling feature can be used to securely couple the module between the single rail and the cut wall surface.

In an example, at least one of the first and second rails 151 and 152 can be a non-linear elongate rail. A non-linear rail can provide for a different design aesthetic than a linear rail, or can accommodate differently shaped internal wall configurations. For example, a non-linear rail can be used to overcome installation obstacles such as internal piping, wiring, insulation, or other materials that can inhibit installation of an in-wall system. In an example, a non-linear rail can include an arced rail. One or more attachment features of a module can be configured to be used with a non-linear rail, such as with a sufficient tolerance to provide slidable engagement between the module and the non-linear rail.

Figure 3A:
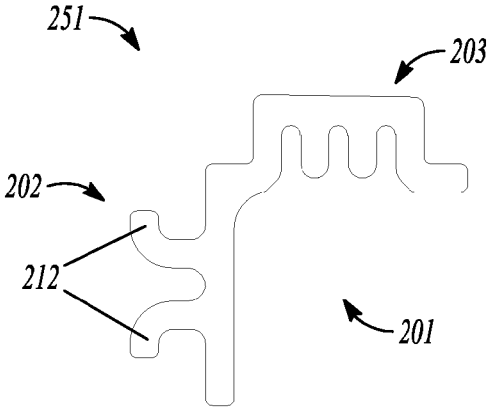
FIG. 3A illustrates generally an example that can include a side view of a mounting rail.
Figure 3B:
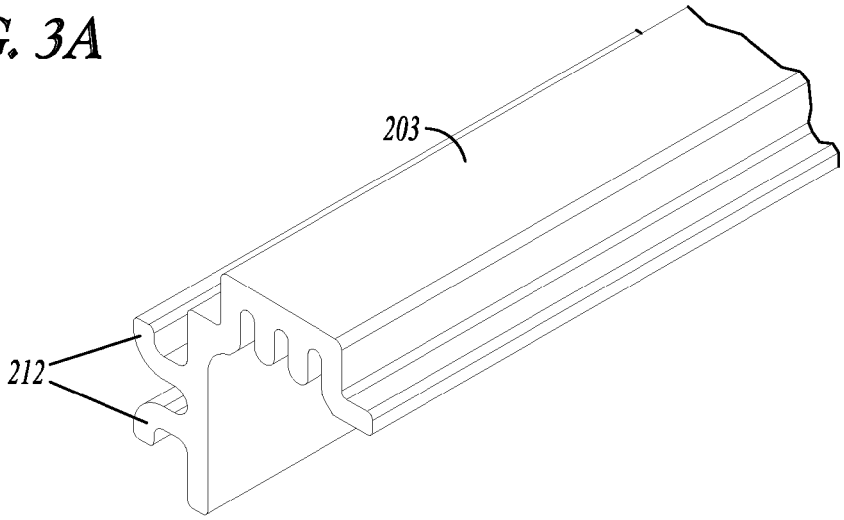
FIG. 3B illustrates generally an example that can include a perspective view of a portion of a mounting rail.

FIGS. 3A and 3B illustrate generally a side view and a perspective view, respectively, of an example of a rail 251 having a contoured flange portion 212. In an example, the rail 251 can correspond to one or both of the first and second rails 151 and 152 in the example of FIG. 1B. The rail 251 can include a wall surface-facing side that can be configured to abut or secure a cut edge of a wall surface. The rail 251 can include a module attachment side that can be configured to slidably engage with or retain one or more modules, such as a loudspeaker module. The rail 251 can include a room-facing side that can be configured to be coupled with a loudspeaker grille or other material to provide a uniform room-facing appearance for the modular system that includes the rail 251.

In the examples of FIGS. 3A and 3B, the rail 251 has an "L" shape with an interior side 201 that can be configured to be positioned at or against an edge of a wall surface, such as a cut edge of a sheetrock or plaster surface. The rail 251 can include a first exterior side 202 that can include the contoured flange portion 212, and can be configured to receive one or more modules using one or more attachment features on the respective modules. The rail 251 can include a second exterior side 203 configured to be positioned substantially parallel to a wall surface, such as to face an interior of a room. The second exterior side 203 can be configured to be used with a grille assembly or other finishing assembly.

The contoured flange portion 212 can be configured to receive one or more attachment features corresponding to one or more modules, such as a loudspeaker module, amplifier module, bracket, spacer, or other component. An attachment feature can include, among other things, a clip, bracket, clamp, or pressure-fit or friction-fit feature. In an example, an attachment feature can provide an interface or connection between a rail-mountable module, bracket, or other component, and a rail system. The attachment feature can provide or facilitate retention of a module or other component at one or more of the rails. An attachment feature can be configured to slidably interface or engage with one or more rails in a rail system. In an example, an attachment feature can have one or more engagement areas, such as can be configured to nest or counter-match with a corresponding portion of a rail.

Figure 4:
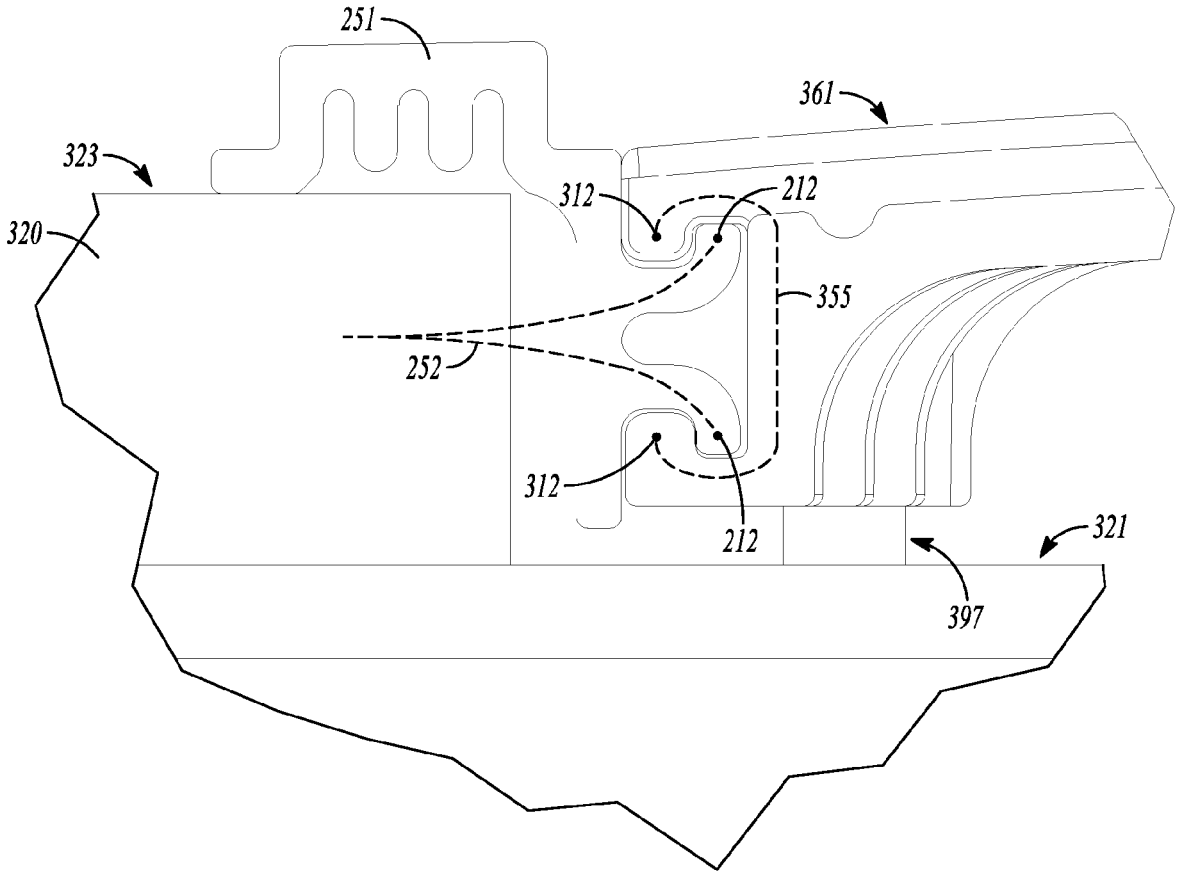
FIG. 4 illustrates generally an example that can include an attachment feature configured to provide an interface between a module and a rail.

FIG. 4 illustrates generally a first example of an attachment feature that can be slidably coupled to a rail. In the example of FIG. 4, a bracket 361 is shown coupled to the rail 251. In an example, one or more of the first, second, or third brackets 161, 162, or 163 in the example of FIG. 1B can correspond to the bracket 361 in the example of FIG. 4.

The bracket 361 can include a flange portion 312 that can be configured to mate with or slidably engage with the contoured flange portion 212 of the rail 251. In an example, the contoured flange portion 212 of the rail 251 can include a Y-shaped protrusion 252 that can be configured to mate or mutually engage with a complementary C-shaped portion 355 of the flange portion 312 of the bracket 361. The flange portion 312 of the bracket 361 and the contoured flange portion 212 of the rail 251 can be configured to inhibit motion of the bracket 361 in multiple different directions, and can be configured to permit the bracket 361 to slide along an elongate dimension of the rail 251, such as along a full length of the rail 251.

To facilitate sliding, a relatively loose or free fit can be provided between the rail 251 and the bracket 361 at the corresponding flange portions. A loose or free fit can permit an installer or other user to approximately or temporarily set in place system elements, such as brackets, spacers, or modules, and yet retain some freedom to adjust the position of the elements relative to the rail. In an example, the loose or free fit can be provided by not fully securing the bracket 361 to a stud 321, such as by not tightening a threaded fastener 397.

In an example, when the bracket 361 is not fully secured to the stud 321, a loose tolerance between the respective flanges of the bracket 361 and the rail 251 can permit the rail 251 to be less than perpendicular to an outer surface 323 of a wall 320. In an example, tightening the threaded fastener 397 can draw together corresponding surfaces of the bracket 361 and the stud 321, and can draw together the contoured flange portion 212 of the rail 251 and the flange portion 312 of the bracket 361. As the bracket 361 and rail 251 are drawn together, such as by tightening the threaded fastener 397, the rail 251 can be driven toward a parallel orientation with an opening in the wall 320.

In an example, an opening in the wall 320 for the rail 251 can be cut perpendicularly to the stud 321, such as to provide a horizontal arrangement for a loudspeaker system that includes the rail 251. In other examples, the opening in the wall 320 for the rail 251 can be cut at an angle relative to the stud 321, such as to mount the rail 251 at an orientation that is other than horizontal.

The bracket 361 and the rail 251 can be dimensioned such that, when the threaded fastener 197 is fully driven into the stud 321, the wall 320 can be torqued-upon by the rail, such as by the interior side 201 of the rail in the example of FIG. 3A. When the wall 320 is torque upon by the rail 251, an edge of the wall 320 near the rail 251 can be drawn or clamped to the stud 321 by way of the bracket 361 and the rail 251. An edge portion of the wall 320 can thereby be rigidly held in place or supported by the rail 251, such as adjacent to or spaced apart from the stud 321. In an example, even when the rail 251 is used a distance away from another stud-to-wall surface fastener (e.g., a fastener used to secure the wall 320 to the stud 321), the wall 320 can be retained in place against the stud 321 by way of the rail 251, the bracket 361, and the fastener 397.

In an example, the entertainment system 100 can be positioned in a wall in an arrangement that can be optimized for a room aesthetic, such as rather than in an arrangement dictated by the structure of the wall. For example, a rail system of the entertainment system 100 can be coupled to one or more studs (e.g., using the first bracket 161) to span one or more wall cavities. In an example, ends of the rail system can include respective brackets that can be coupled to respective studs. In an example, an end of the rail system can be positioned intermediately between wall studs such that a bracket positioned at the end of the rail system would not be coupled against a stud. The present inventors have recognized that a problem to be solved can include securing an end of the rail system when the end of the rail system does not correspond to a stud location, such as to provide support for one or more modules coupled to the rail system near the rail end.

Figure 5:
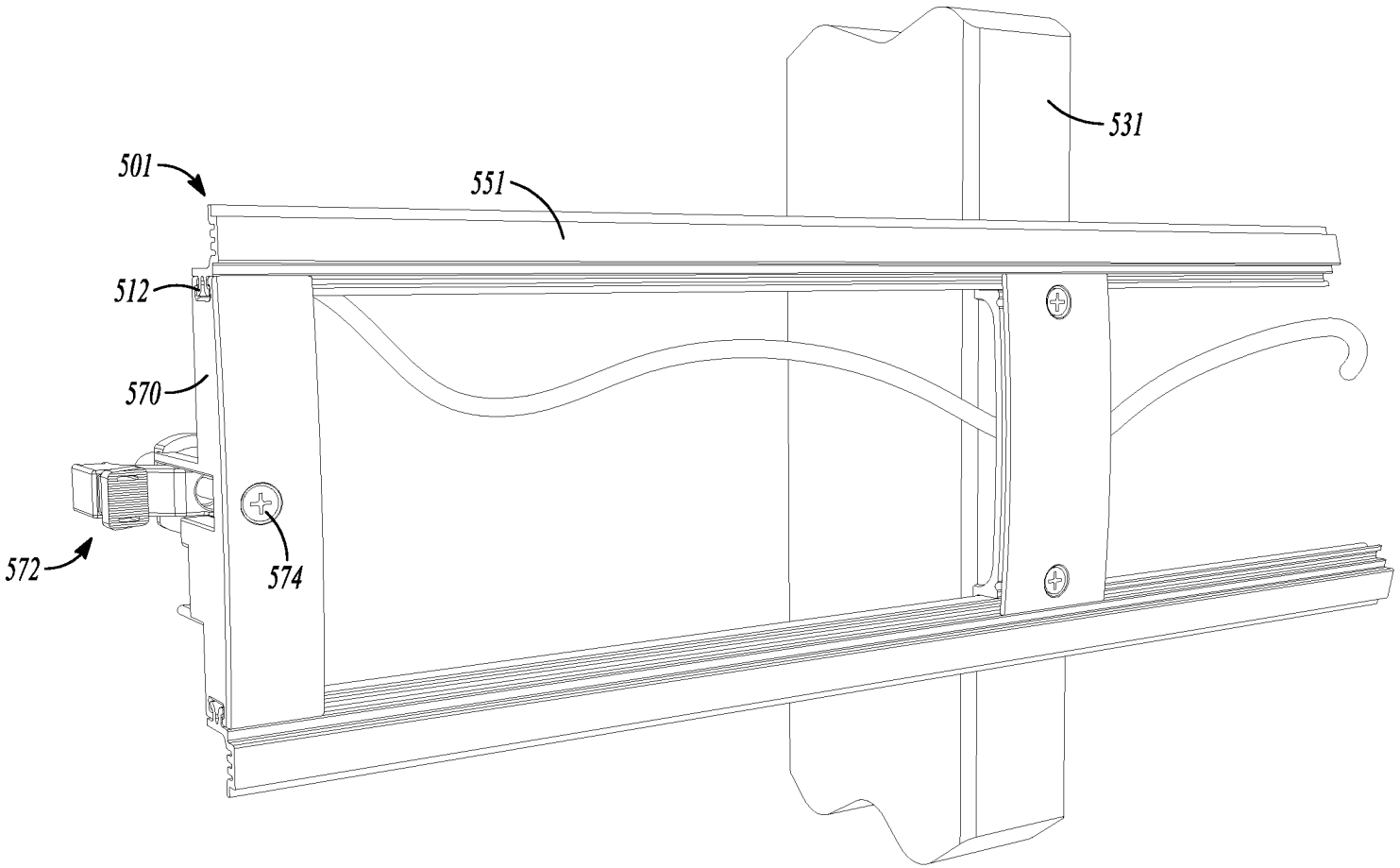
FIG. 5 illustrates generally an example that can include a rail-mounted clamp assembly.

FIG. 5 illustrates generally an example of an end-of-rail rotating clamp assembly 570. The rotating clamp assembly 570 can be positioned at an end 501 of a rail 551, such as corresponding to a wall cavity bounded in part by a nearby stud 531. In an example, a rotating clamp assembly 570 can be similarly constructed to the first bracket 161 shown generally in the example of FIG. 2, however, the rotating clamp assembly 570 can include a clamp portion 572 that can extend laterally away from the stud-side surface of the assembly, such as in the direction of the rail 551. The rotating clamp assembly 570 can include a flange portion 512 that can be configured to mate with or slidably engage with a corresponding flange portion of the rail 551.

The clamp portion 572 of the rotating clamp assembly 570 can be configured to adjustably extend away from the rotating clamp assembly 570, such as in the direction of the rail 551. In an example, the clamp portion 572 can extend toward and contact an inner, stud-side of a wall surface to which the rail 551 is coupled. The rotating clamp assembly 570 can include an adjustment member 574, such as can be used to extend or retract the clamp portion 572. Once the clamp portion 572 is securely positioned against a nearby inner, stud-side of a wall surface, a locking device (not shown) can be deployed to secure the position of the clamp portion 572. In an example, the rail 551 can be coupled to a sheetrock wall surface, and the clamp portion 572 can be configured to extend toward a stud-side (or internal cavity-side) of the sheetrock wall surface. By way of the clamp portion 572, the rotating clamp assembly 570 can be used to affix or secure an end portion of the rail 551.

The present inventors have recognized that a problem to be solved can include providing a modular loudspeaker system that is configurable at a point of installation, such as using multiple different system modules. The present subject matter can provide a solution to this problem, such as by providing a method and structural components that can permit modular system components to be adjustably and slidably coupled to a rail. The system components or modules can be configured to be securable in a specified position such that the individual components do not buzz, rattle, or physically move relative to their installed position, such as due to vibratory forces experienced during use of the loudspeaker system.

Figure 6:
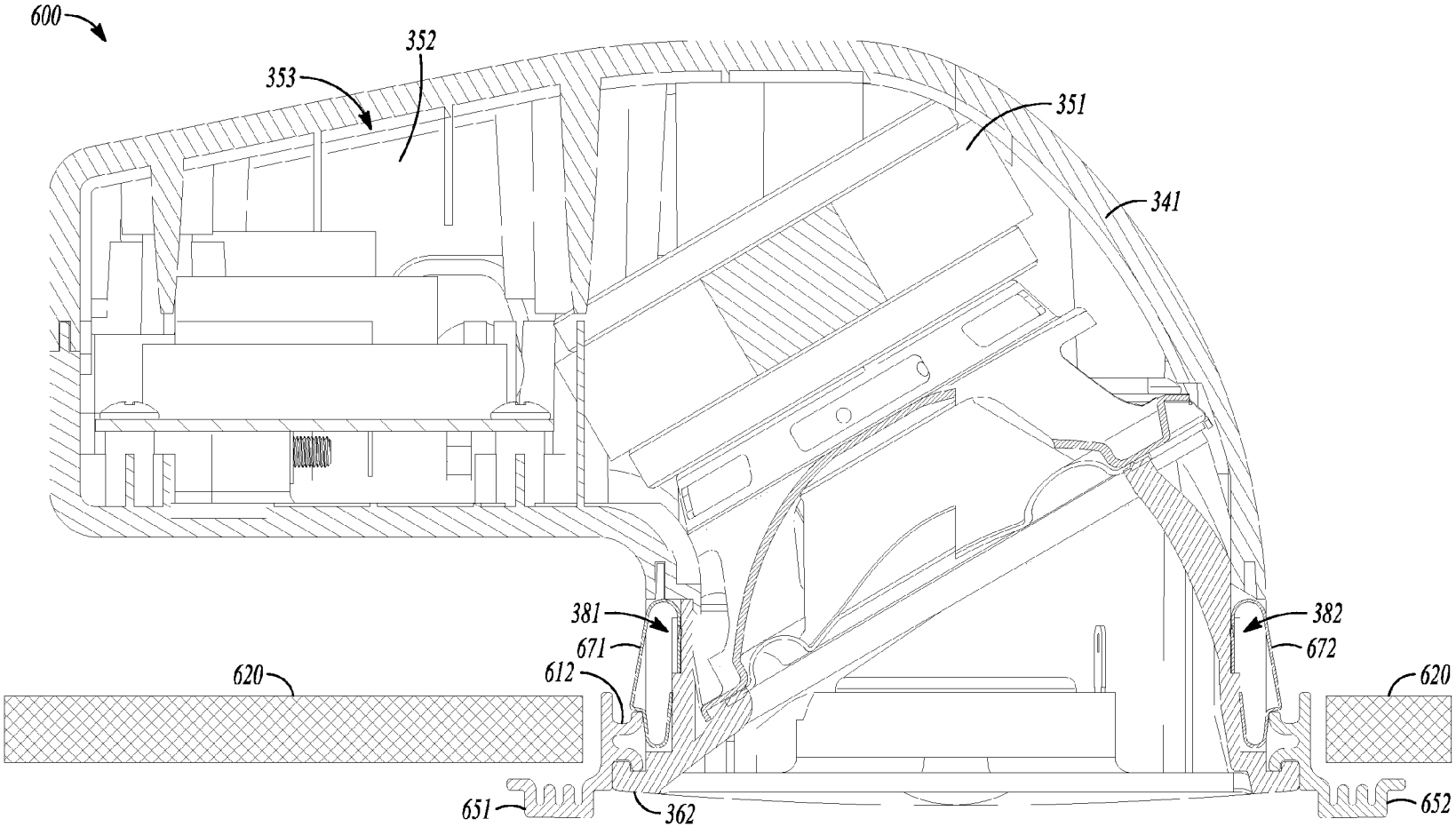
FIG. 6 illustrates generally an example that can include a loudspeaker module.

FIG. 6 illustrates generally an example 600 that can include a portion of the loudspeaker system 110 of FIG. 1A. The example 600 can include a loudspeaker module 341 that can be installed in a wall 620 and reproduce high fidelity sound, such as without buzz, rattle, or movement of the loudspeaker module 341 relative to the wall 620 or relative to one or more rails to which the loudspeaker module 341 is coupled. In the example of FIG. 6, the loudspeaker module 341 includes a loudspeaker driver 351 positioned in a loudspeaker cabinet 352. The loudspeaker cabinet 352 can include a baffle system 353, such as including one or more ports or diffusers. The loudspeaker module 341 can be coupled to first and second rails 651 and 652, such as using a module flange 362 that can be configured to engage with a corresponding flange 612 of a rail.

The loudspeaker module 341 can be substantially "L" shaped. In an example, the loudspeaker module 341 includes a cone of the loudspeaker driver 351 that can be positioned to provide or expel sound from a first open end, or front face, of the module. The loudspeaker cabinet 352 can extend substantially orthogonally away from the front face of the module, such as into a wall cavity when the loudspeaker module 341 is installed in the wall 620. The loudspeaker cabinet 352 can include a turn of about 90 degrees, and the cavity can continue to extend substantially perpendicular to the front face of the module, and the module can terminate at a substantially closed end. In an example, the substantially closed end can include a port that can be tuned to provide a particular frequency response when the loudspeaker driver 351 is used with the loudspeaker cabinet 352 in the wall cavity.

In an example, the loudspeaker module 341 can be installed against the first and second rails 651 and 652 by rotating the loudspeaker module 341 into a wall cavity. For example, the substantially closed end of the module can be inserted between the first and second rails 651 and 652. The loudspeaker module 341 can then be rotated about 90 degrees, such as toward an interior wall cavity or void area, to position the loudspeaker cabinet 352 portion of the module inside the wall cavity, such as behind the wall 620 and behind the first and second rails 651 and 652. The loudspeaker module 341 can then be forcibly snapped into place to couple together the rail flange 612 and a corresponding module flange 362. In an example, the loudspeaker module 341 can include one or more spring features to securely couple the module to the rail system.

In an example, first or second spring clips 671 or 672 can be used to secure the loudspeaker module 341 with the first and second rails 651 or 652, respectively. In an example, the loudspeaker module 341 can include a first clip recess 381 and a second clip recess 382. The first and second clip recesses 381 and 382 can be configured to receive the first and second spring clips 671 and 672, respectively. The first and second clip recesses 381 and 382 can be arranged on opposite sides of the loudspeaker module 341 such that the clips can provide opposing spring pressures. That is, the first spring clip 671 can force the loudspeaker module 341 in a first direction away from the first rail 651, and the second spring clip 672 can force the loudspeaker module 341 in a second, opposite direction, such as away from the second rail 652. In this manner, the loudspeaker module 341 can be secured or pressure-fit between the first and second rails 651 and 652.

Figure 7:
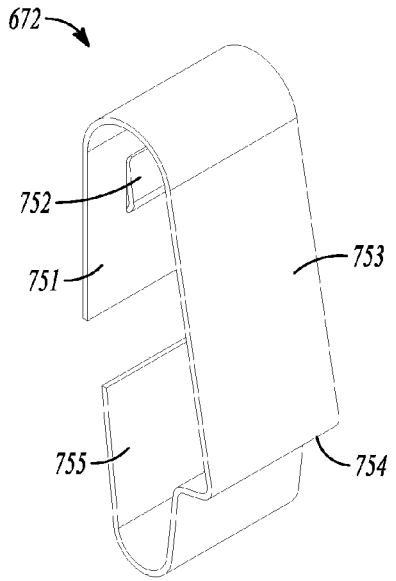
FIG. 7 illustrates generally an example that can include a mounting clip.

FIG. 7 illustrates generally an example of the spring clip 672. In an example, the spring clip 672 can include at least two flexible or compressible surfaces. The spring clip 672 can include a first surface 753. The first surface 753 can be configured to guide the spring clip 672 over a rail edge (e.g., including one or more rail flange portions). The spring clip 672 can include a second surface 755 that can be configured to force a captured-edge portion 754 of the spring clip 672 against a rail when the clip is installed. The captured-edge portion 754 can include a detent or step in the spring clip 672, such as for mating with a corresponding protrusion or flange, such as in one or more of the loudspeaker module 341 or the second rail 652.

The spring clip 672 can include an attachment flange 751 that can be configured to be inserted into or coupled with a clip recess, such as the first or second clip recess 381 or 382 in the example of FIG. 6. The attachment flange 751 can be positioned on the second surface 755 side of the spring clip 672, such as with a space or discontinuity between the attachment flange 751 and the second surface 755 edge, such as shown in the example of FIG. 7.

The spring clip 672 can include a reverse-capture flange 752 that can be configured to prevent unwanted extraction of the spring clip from a clip recess. In an example, the reverse-capture flange 752 can include an edge that can be driven into a surface of a module to be mounted using the spring clip 672.

For example, the edge can be driven into a plastic surface of a module to secure the spring clip 672 to the module body.

In an example, the loudspeaker module 341 can be inserted into a frame that includes the first and second rails 651 and 652. As the loudspeaker module 341 is inserted, the first surface 253 of the spring clip 672 can deform or deflect to accommodate one or more flanges of the second rail 652. In an example, a force provided by an installer by hand can be sufficient to overcome a resistance provided by the spring clip 672 against the second rail 652. Under adequate insertion force by an installer, the captured-edge portion 754 can snap into place and relax, such as after passing an inner flange portion of the second rail 652. When fully inserted, the second surface 755 of the spring clip 672 can be configured to continuously exert or provide a retention force between an inner flange of the second rail 652 and the module flange 362 such that the loudspeaker module 341 can be securely retained.

Figure 8:
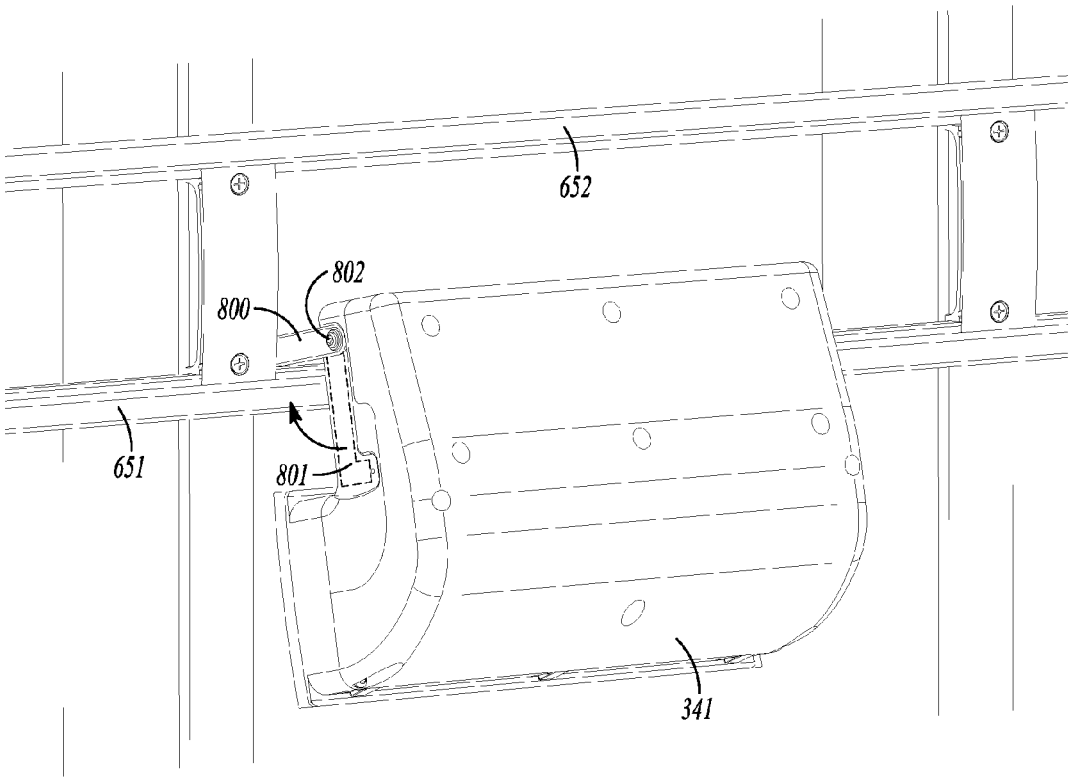
FIG. 8 illustrates generally an example that can include a loudspeaker module.

FIG. 8 illustrates generally an example of the loudspeaker module 341 and the first and second rails 651 and 652. In an example, multiple physical connections can be made between the loudspeaker module 341 and one or more other modules, such as electrical wire connections, optical connections, or other connections. Accordingly, the present inventors have recognized that a problem to be solved can include approximately positioning the loudspeaker module 341, such as without securely locking the loudspeaker module 341 into place against the first and second rails 651 and 652, to enable an installer to configure or reconfigure a physical connection or adjust a position of the loudspeaker module 341. The present subject matter can provide a solution to this problem, such as by providing a rotating arm 800. In an example, a module can include a rotating arm 800 on at least two sides of the module to provide module stability when the module is hung by the arms.

In an example, the rotating arm 800 can be positioned against the body of the loudspeaker module 341, such as shown in phantom lines in the example of FIG. 8. The rotating arm 800 can include a hook portion 801 at an end of the rotating arm 800 that is opposite an arm pivot 802. In an unused position, the rotating arm 800 can be secured or retained against the body of the loudspeaker module 341. When the loudspeaker module 341 is to be installed, the rotating arm 800 can be rotated away from the body about the pivot 802.

The hook portion 801 can be configured to engage a bottom rail, such as the second rail 651, when the rotating arm 800 is rotated away from the loudspeaker module 341 body. The rotating arm 800 can be configured to support a weight of the loudspeaker module 341 such that the loudspeaker module 341 can hang by the rotating arm 800 while the installer performs other tasks. In an example, the loudspeaker module 341 can be approximately positioned along a rail system using the rotating arm 800 and coupled to one or more other modules using a physical connector. Once the layout of the system is finalized, the loudspeaker module 341 can be rotated and secured into place against the rails, such as using one or more spring clips or other attachment features configured to couple a module to a rail.

Figure 9:
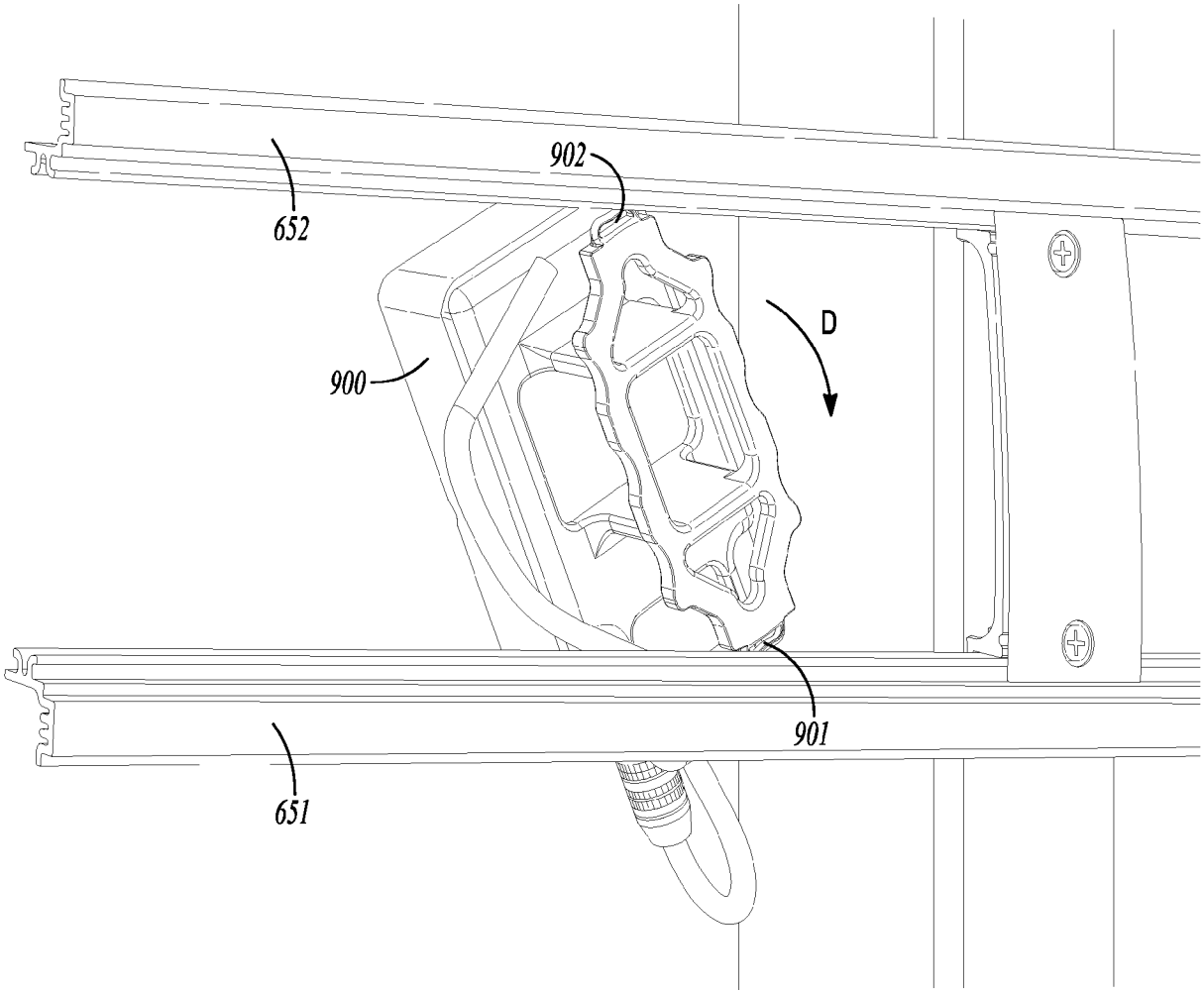
FIG. 9 illustrates generally an example of a module that can include a twist-in attachment feature.

FIG. 9 illustrates generally an example of a module 900 that can include an example of an attachment feature. In an example, the module 900 can include a wireless transceiver module, a loudspeaker module, an amplifier module, a crossover or other filter module, or some other type of module. The module 900 can be configured to be installed against, or coupled with, the first and second rails 651 and 652.

The module 900 can include first and second attachment features 901 and 902. The first and second attachment features 901 and 902 can be compressible or deformable to provide a pressure fit against the first and second rails 651 and 652. In an example, the module 900 can be installed by slightly rotating the module 900 such that side corners of the first and second attachment features 901 and 902 are positioned at the first and second rails 651 and 652, respectively. The module 900 can then be rotated in the direction D to forcibly compress the first and second attachment features 901 and 902 against the first and second rails 651 and 652, respectively. As the module 900 rotates, the first and second attachment features 901 and 902 can be further compressed until the module 900 is oriented perpendicularly to the rails.

A room-facing side of the loudspeaker system 110 can include a loudspeaker grille, screen, or front face assembly (herein, "grille assembly"). The grille assembly can provide a uniform, aesthetically pleasing appearance of the system. In an example, the grille assembly can at least partially mask or cover gaps between modules, module spacing irregularities, or other asymmetries in the system. For example, asymmetry may exist due to physical limitations imposed by internal wall stud locations. In an example, the grille assembly can provide a convenient location to provide an indicia of a brand or other characteristic of the loudspeaker system 110.

In an example, a grille assembly can be coupled to a frame of the loudspeaker system 110. For example, a grille assembly can be coupled to one or more rails of the loudspeaker system 110. In an example, the grille can be press-fit or magnetically coupled to a rail assembly. For example, at least one rail can include a recess configured to receive an edge of a grille assembly, and a grille assembly can be friction-fit with the recess. In an example, at least one rail can include a magnet, or can itself be magnetic, and the grille assembly can attach to the at least one rail. In an example, the grille assembly can be magnetic, or can include a magnetic component, and the grille assembly can be coupled to the at least one rail.

Figure 10:
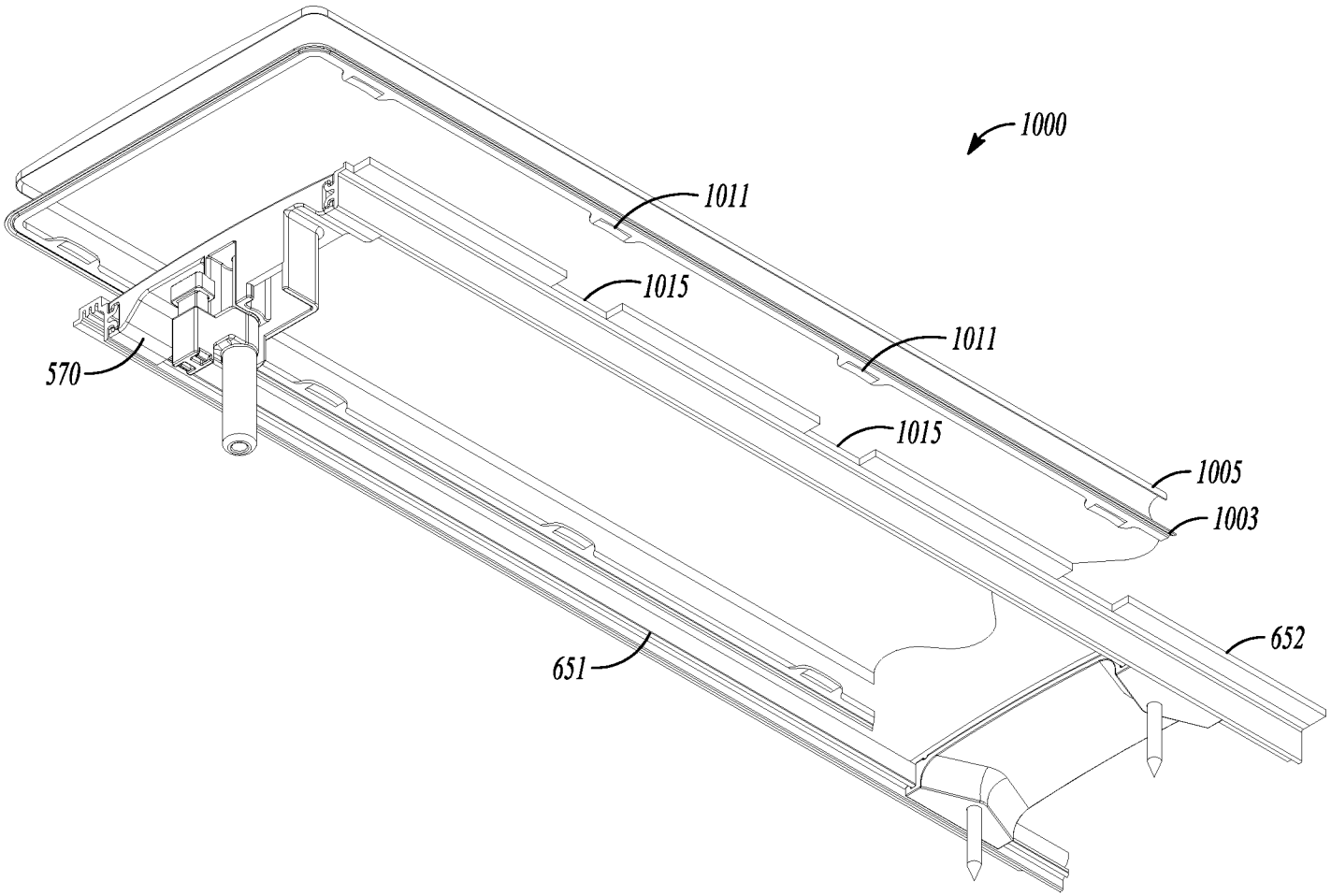
FIG. 10 illustrates generally an example that can include a grille assembly.

FIG. 10 illustrates generally an example of a grille assembly 1000 that can include a laterally-actuated, slide-on, tab and flange system. The grille assembly 1000 can include a trim 1003 and a substantially acoustically transparent covering 1005. In an example, the trim 1003 can include an injected-molded polymer, and the covering 1005 can include a press-formed, acoustically transparent, perforated-metal sheet. The trim 1003 can include a mating feature, such as a recessed-slot that can run about a periphery of the trim 1003. In an example, the covering 1005 can include a flange portion that can be inserted into the recessed slot of the trim 1003. In an example, the covering 1005 and trim 1003 can be coupled (e.g., ultrasonically welded) to provide the grille assembly 1000.

In an example, the grille assembly 1000 can attach to the first and second rails 651 and 652 using one or more retention tabs 1011. The retention tabs 1011 can face inward, toward a central portion of the grille assembly 1000. The retention tabs 1011 can be oriented and spaced apart such that they are configured to engage with corresponding matching slots 1015, such as can be machined into or provided in respective edges of the first and second rails 651 and 652. In an example, the retention tabs 1011 can be inserted between an overhanging portion of a rail and a wall surface, such as a drywall surface, adjacent to the rail.

In an example, installing the grille assembly 1000 can include aligning the grille assembly 1000 in parallel with a rail, and above and slightly off-center (longitudinally) relative to the rail. In an example, an installer can align the retention tabs 1011 with the rails' slots 1015 and then move the grille assembly 1000 toward the wall surface. When an entire periphery of the trim 1003 is flush with the wall surface, the installer can apply a lateral force, either toward the left or toward the right, as required to center the grille assembly 1000 (e.g., to center the grille assembly 1000 relative to another entertainment system component, such as a flat panel display).

In an example, the grille assembly 1000 can be immobilized in the installed position, and a bottom of the trim 1003 can be positioned flush to a wall surface, such as by providing small, slightly compressible polymer trim-molding springs (herein "trim-molding springs"). A trim-molding spring can be incorporated into the retention tabs 1011. In an example, the trim-molding springs can be shaped with a small radius that can be positioned to provide a small amount of interference between a rail's flanges and a wall surface. The interference can act in multiple ways. If a clearance is larger than nominal tolerances predict, then the interference can take up the slack created by the over-sized clearance. If a clearance is nominal or smaller that standard tolerance predicts, then the trim-molding springs can deform to allow successful installation of the grille assembly 1000.

Interference can benefits the assembly in multiple ways, for example, to ensures secure, buzz-free, positioning or immobilization of the grille assembly 1000. In addition, the interference can mask installations having a wall surface that is not adequately parallel or flat enough relative to the first and second rails 651 and 652. When the wall surface is insufficiently flat such that it can create one or more gaps, a trim-molding spring can absorb the slack and press the grille assembly 1000 flush to the wall's surface, thereby minimizing or eliminating gaps.

The present inventors have recognized that a problem to be solved can include providing a user-scalable grille assembly. The present subject matter can help to provide a solution to this problem, such as by using a magnetic system. In an example, the magnetic system can provide a methodology that enables a practical way to manufacture a wide variety of grille widths without incurring high tooling and manufacturing costs.

In an example, a magnetic modular grille can be retained in place using multiple high-energy (typically rare-earth, such as neodymium) magnets. Traditionally, magnetically retained in-wall and/or in-ceiling loudspeaker grille assemblies can be fabricated using a shaped perforated ferrous metal that is acoustically transparent, and whose perimeter is cosmetically finished with an injection-molded plastic "trim". However, injection-molds can be expensive, such as in part due to tooling costs for multiple differently-sized pieces.

The present inventors have recognized that a solution to this problem can include using a modular construction technique. Compared to the grille assembly 1000, a magnetic modular grille can be easier to install because there can be no requirement to pre-align an array of slide-on tabs with a matching array of mating slots. In an example, a magnetic modular grille may not provide compensation for wall flatness variations, however, these variations can be overcome with an aesthetic design that intentionally suggests that a grille is "floating" slightly off of a wall surface, thereby camouflaging small flatness difference variations.

Figure 11:
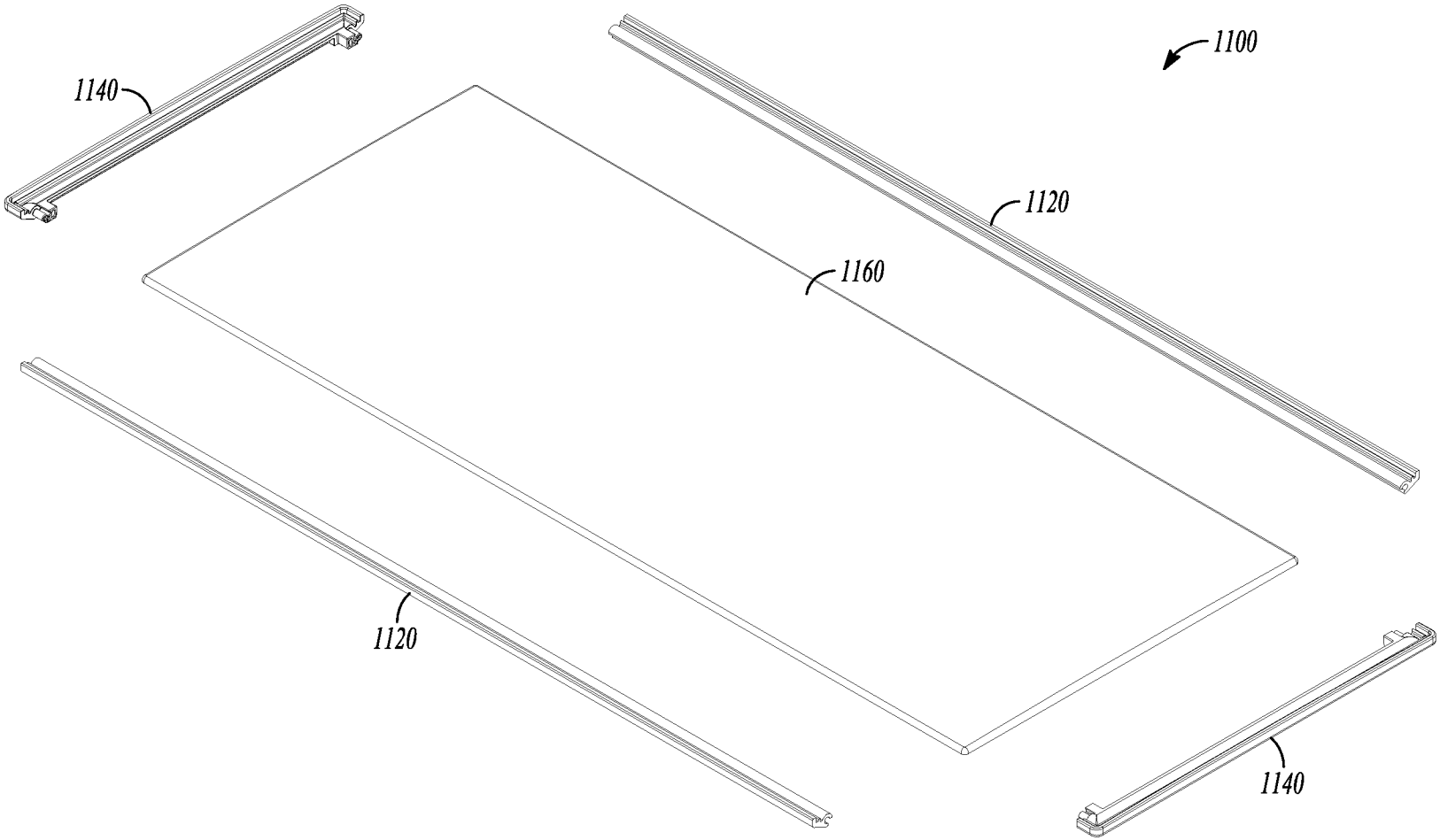
FIG. 11 illustrates generally an example that can include a magnetic grille assembly.

FIG. 11 illustrates generally an example of a magnetic grille assembly 1100. The magnetic grille assembly 1100 can include a pair of trim pieces 1120, a pair of end caps 1140, and a cover 1160. In an example, the trim pieces 1120 or the end caps 1140 can be extruded, cast, machined, or molded. The cover 1160 can be a ferrous, perforated-metal and acoustically-transparent stamped cover 1160.

In an example, the magnetic grille assembly 1100 can be simple to manufacture in multiple different sizes, or widths, because the trim pieces 1120 can be cut to any required length. In addition, different end caps 1140 can be provided to accommodate different vertical grille assembly dimensions. In an example, the end caps 1140 can be corner pieces, and adjustable trim pieces 1120 can be used for each of the four sides of the magnetic grille assembly. In an example, the end caps 1140 can include one or more mating features (e.g., protrusions or corresponding receptacles) that can permit assembly of the end caps 1140 and respective trim pieces 1120, and can be configured to prevent or restrain relative rotation of the trim pieces 1120. In an example, each of the trim pieces 1120 can include a profile having a receiving slot that can capture an edge of the cover 1160.

VARIOUS NOTES & EXAMPLES

Example 1 can include or use subject matter (such as an apparatus, a method, a means for performing acts, or a device readable medium including instructions that, when performed by the device, can cause the device to perform acts), such as can include or use a modular sound component system. In Example 1, the modular sound component system can be configured to be located at least partially within a wall, wherein the wall comprises a planar wall surface coupled to substantially vertical studs with corresponding wall cavities between the vertical studs. In Example 1, the modular sound component system can include a rail system, configured to contact the wall, wherein the rail system includes at least one elongate rail. The modular sound component system can include one or more modules, such as a first module comprising a first module face, a first module body configured to carry a loudspeaker, and a first rail attachment feature, or a second module comprising a second module face, a second module body, and a second rail attachment feature. In Example 1, the first and second modules can be configured to be respectively coupled by the respective first and second rail attachment features to the at least one rail to position the first module body in a first wall cavity and to position the second module body in a second wall cavity that is spaced apart from the first wall cavity by at least one of the vertical studs.

Example 2 can include, or can optionally be combined with the subject matter of Example 1, to optionally include at least one of the first and second modules slidably coupled by the respective one of the first and second rail attachment features to the at least one rail.

Example 3 can include, or can optionally be combined with the subject matter of one or any combination of Examples 1 or 2 to optionally include the rail system, including two elongate rails, such as wherein the first and second modules are each configured to be coupled to each of the two elongate rails.

Example 4 can include, or can optionally be combined with the subject matter of Example 3, to optionally include the first and second modules respectively slidably coupled by the first and second rail attachment features to the two elongate rails.

Example 5 can include, or can optionally be combined with the subject matter of one or any combination of Examples 1 through 4 to optionally include the first rail attachment feature, including a compressible and extensible portion of the attachment feature that is configured to be compressible in response to an insertion force used to couple the first module to the at least one rail. In Example 5, the attachment feature can be configured to extend into a relaxed configuration when the first module is coupled to the at least one rail.

Example 6 can include, or can optionally be combined with the subject matter of Example 5, to optionally include the at least one elongate rail, including a flange along a length of the elongate rail. In Example 6, the first rail attachment feature can include a hook portion, such as can be configured to engage a wall-side surface of the flange. In Example 6, the compressible and extensible portion of the first rail attachment feature can be configured to engage an opposite side of the flange.

Example 7 can include, or can optionally be combined with the subject matter of one or any combination of Examples 1 through 6 to optionally include the first module face configured to be aligned within a specified distance of the wall surface when the first attachment feature is coupled to the at least one elongate rail.

Example 8 can include, or can optionally be combined with the subject matter of one or any combination of Examples 1 through 7 to optionally include the first and second modules, such as can be communicatively coupleable using a communication link that is configured to extend across a wall surface-side of the at least one of the vertical studs.

Example 9 can include, or can optionally be combined with the subject matter of one or any combination of Examples 1 through 8 to optionally include the first module, such as including a loudspeaker driver or other loudspeaker component installed in the first module body.

Example 10 can include, or can optionally be combined with the subject matter of one or any combination of Examples 1 through 9 to optionally include the second module body of the second module configured to carry a loudspeaker.

Example 11 can include, or can optionally be combined with the subject matter of one or any combination of Examples 1 through 10 to optionally include the second module body of the second module configured to carry a loudspeaker amplifier.

Example 12 can include, or can optionally be combined with the subject matter of Example 11, to optionally include a loudspeaker amplifier installed in the second module body of the second module.

Example 13 can include, or can optionally be combined with the subject matter of one or any combination of Examples 1 through 12 to optionally include the first module body configured to carry a loudspeaker amplifier.

Example 14 can include, or can optionally be combined with the subject matter of one or any combination of Examples 1 through 13 to optionally include the second module, including a spacing module configured to be slidably coupled by the second rail attachment feature to the at least one rail. In Example 14, the spacing module can be configured to be coupled to the at least one of the vertical studs.

Example 15 can include, or can optionally be combined with the subject matter of one or any combination of Examples 1 through 14 to optionally include a grille assembly configured to be coupled to and extend along the rail system to cover the first and second module faces.

Example 16 can include, or can optionally be combined with the subject matter of Example 15, to optionally include the grille assembly, such as including a grille surface and a modular grille frame. In Example 16, the grille surface can have a grille perimeter, and the modular grille frame can be configured to be customizable by a user to receive the grille surface at the grille perimeter.

Example 17 can include, or can optionally be combined with the subject matter of Example 16, to optionally include the grille assembly, such as can be configured to be removably coupled to the rail system using a magnet, and wherein the magnet can be fixedly coupled to the at least one elongate rail.

Example 18 can include, or can optionally be combined with the subject matter of one or any combination of Examples 16 or 17 to optionally include at least one of the modular grille frame or the at least one rail includes a flexible fastener configured to couple the modular grille frame and the at least one rail.

Example 19 can include, or can optionally be combined with the subject matter of one or any combination of Examples 1 through 18 to optionally include a power supply unit configured to be disposed in a common wall cavity with one of the first and second modules.

Example 20 can include, or can optionally be combined with the subject matter of one or any combination of Examples 1 through 19 to optionally include the first module, such as including multiple loudspeaker transducers.

Example 21 can include, or can optionally be combined with the subject matter of one or any combination of Examples 1 through 20 to optionally include the at least one elongate rail, and wherein the at least one elongate rail is linear.

Example 22 can include, or can optionally be combined with the subject matter of one or any combination of Examples 1 through 20 to optionally include the at least one elongate rail, and wherein the at least one elongate rail is arcuate.

Example 23 can include, or can optionally be combined with the subject matter of one or any combination of Examples 1 through 22 to include, subject matter (such as an apparatus, a method, a means for performing acts, or a machine readable medium including instructions that, when performed by the machine, that can cause the machine to perform acts), such as can include a loudspeaker assembly configured to be installed at least partially within a wall. In Example 23, the loudspeaker assembly can include first and second elongate rails, and a loudspeaker module, including a front face and a loudspeaker cabinet body that extends orthogonally away from the front face, turns about 90 degrees, and extends parallel to the front face of the loudspeaker module (see, e.g., FIG. 6). Example 23 can optionally include first and second compression clips. In Example 23, the loudspeaker module can include first and second edges on opposite sides of the module, and the first and second edges can be configured to mate respectively with the first and second elongate rails using respective ones of the first and second compression clips. In Example 23, the loudspeaker module front face can be configured to be aligned within a specified distance of a surface of the wall when the loudspeaker module is mated with the first and second elongate rails.

Example 24 can include, or can optionally be combined with the subject matter of Example 23, to optionally include the first compression clip includes a formed sheet having a discontinuity in a first long side of the clip and a step detent along an opposite long side of the clip.

Example 25 can include, or can optionally be combined with the subject matter of Example 24, to optionally include the first compression clip includes a flange portion that extends away from an interior of the clip, and the flange can be disposed on the first long side of the clip near the discontinuity.

Example 26 can include, or can optionally be combined with the subject matter of one or any combination of Examples 23 through 25 to optionally include the first elongate rail including substantially orthogonal or perpendicular first and second elongate surfaces. In Example 26, the first elongate surface can be configured to extend over a wall surface that is adjacent to the first elongate rail, and the second elongate surface can include a flange, such as can be distributed along a length of the second elongate surface. The flange can be configured to mate with the first edge of a loudspeaker module.

Example 27 can include, or can optionally be combined with the subject matter of one or any combination of Examples 23 through 26 to optionally include a grille assembly, the grille assembly including a perforated screen and first and second trim members. In Example 27, the first and second trim members can be configured to be respectively coupled to the first and second elongate rails. In Example 27, the perforated screen can be configured to be coupled to the first and second trim members.

Example 28 can include, or can optionally be combined with the subject matter of Example 27, to optionally include the first and second trim members, including respective first and second slots disposed along respective portions of the trim members. In Example 28, the perforated screen can include side edges having deflectable flanges, and the first and second slots can be configured to receive the deflectable flanges of the perforated screen.

Example 29 can include, or can optionally be combined with the subject matter of one or any combination of Examples 1 through 28 to include, subject matter (such as an apparatus, a method, a means for performing acts, or a machine readable medium including instructions that, when performed by the machine, that can cause the machine to perform acts), such as can include a modular sound component system configured to be located at least partially within a wall, wherein the wall comprises a planar wall surface coupled to substantially vertical studs with corresponding wall cavities between the vertical studs. In Example 29, the modular sound component system can include a rail system configured to contact the wall. The rail system can include first and second linear elongate rails. Example 29 can include a first loudspeaker module, such as including a first loudspeaker module face, a first loudspeaker cabinet configured to receive a first loudspeaker, and first and second rail attachment features disposed on opposite side edges of the first loudspeaker module near the first loudspeaker module face. Example 29 can optionally include a second loudspeaker module including a second loudspeaker module face, a second loudspeaker cabinet configured to receive a second loudspeaker, and third and fourth rail attachment features disposed on opposite side edges of the second loudspeaker module near the second loudspeaker module face. Example 29 can optionally include a spacer module, such as can include fifth and sixth rail attachment features and a stud attachment feature. In Example 29, the first loudspeaker module can be configured to be slidably coupled to the first and second rails using the first and second rail attachment features, respectively, to position the first loudspeaker cabinet in a first wall cavity. In Example 29, the second loudspeaker module can be configured to be slidably coupled to the first and second rails using the third and fourth rail attachment features, respectively, to position the second loudspeaker cabinet in a second wall cavity that is spaced apart from the first wall cavity by at least one of the vertical studs. In Example 29, the spacer module can be configured to be slidably coupled to the first and second rails using the fifth and sixth rail attachment features, respectively, or the spacer module can be configured to be coupled to the at least one of the vertical studs between the first and second wall cavities.

Example 30 can include, or can optionally be combined with the subject matter of Example 29, to optionally include a communication link that can be configured to extend over a wall-side surface of the at least one stud to couple the first and second loudspeaker modules.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A modular sound component system configured to be located at least partially within a wall, wherein the wall comprises a planar wall surface coupled to substantially vertical studs with corresponding wall cavities between the vertical studs, the modular sound component system comprising:

a rail system, configured to contact the wall, wherein the rail system includes at least one elongate rail;

a first module comprising a first module face, a first module body configured to carry a loudspeaker, and a first rail attachment feature; and a second module comprising a second module face, a second module body, and a second rail attachment feature;

wherein the first and second modules are configured to be respectively coupled by the respective first and second rail attachment features to the at least one rail to position the first module body in a first wall cavity and to position the second module body in a second wall cavity that is spaced apart from the first wall cavity by at least one of the vertical studs.

2. The modular sound component system of claim 1, wherein at least one of the first and second modules is slidably coupled by the respective one of the first and second rail attachment features to the at least one rail.

3. The modular sound component system of claim 1, wherein the rail system includes two elongate rails, and wherein the first and second modules are each configured to be coupled to each of the two elongate rails.

4. The modular sound component system of claim 3, wherein the first and second modules are respectively slidably coupled by the first and second rail attachment features to the two elongate rails.

5. The modular sound component system of claim 1, wherein the first rail attachment feature includes a compressible and extensible portion that is configured to be compressible in response to an insertion force used to couple the first module to the at least one rail, and wherein the attachment feature is configured to extend into a relaxed configuration when the first module is coupled to the at least one rail.

6. The modular sound component system of claim 5, wherein the at least one elongate rail includes a flange along a length of the elongate rail, and wherein the first rail attachment feature includes a hook portion that is configured to engage a wall-side surface of the flange, and wherein the compressible and extensible portion of the first rail attachment feature is configured to engage an opposite side of the flange.

7. The modular sound component system of claim 1, wherein the first module face is configured to be aligned within a specified distance of the wall surface when the first attachment feature is coupled to the at least one elongate rail.

8. The modular sound component system of claim 1, wherein the first and second modules are communicatively coupleable using a communication link that is configured to extend across a wall surface-side of the at least one of the vertical studs.

9. The modular sound component system of claim 1, wherein the first module comprises a loudspeaker installed in the first module body.

10. The modular sound component system of claim 1, wherein the second module body of the second module is configured to carry at least one of a loudspeaker transducer or a loudspeaker amplifier.

11. The modular sound component system of claim 1, wherein the first module body of the first module is configured to carry a loudspeaker amplifier.

12. The modular sound component system of claim 1, wherein the second module comprises a spacing module configured to be slidably coupled by the second rail attachment feature to the at least one rail, and wherein the spacing module is further configured to be coupled to the at least one of the vertical studs.

13. The modular sound component system of claim 1, comprising a grille assembly configured to be coupled to and extend along the rail system to cover the first and second module faces, wherein the grille assembly comprises a grille surface and a modular grille frame, wherein the grille surface has a grille perimeter, and wherein the modular grille frame is configured to be customizable by a user to receive the grille surface at the grille perimeter.

14. The modular sound component system of claim 1, comprising a power supply unit configured to be disposed in a common wall cavity with one of the first and second modules.

15. A loudspeaker assembly configured to be installed at least partially within a wall, the loudspeaker assembly comprising:

first and second elongate rails;

a loudspeaker module, including a front face and a loudspeaker cabinet body that extends orthogonally away from the front face, turns about 90 degrees, and extends parallel to the front face of the loudspeaker module; and first and second compression clips;

wherein the loudspeaker module includes first and second edges on opposite sides of the module, and the first and second edges are configured to mate respectively with the first and second elongate rails using respective ones of the first and second compression clips; and wherein the loudspeaker module front face is configured to be aligned within a specified distance of a surface of the wall when the loudspeaker module is mated with the first and second elongate rails.

16. The loudspeaker assembly of claim 15, wherein the first compression clip comprises a formed sheet having a discontinuity in a first long side of the clip and a step detent along an opposite long side of the clip, and wherein the first compression clip comprises a flange portion that extends away from an interior of the clip, the flange disposed on the first long side of the clip near the discontinuity.

17. The loudspeaker assembly of claim 15, wherein the first elongate rail comprises orthogonal first and second elongate surfaces;

wherein the first elongate surface is configured to extend over a wall surface that is adjacent to the first elongate rail; and wherein the second elongate surface includes a flange that is distributed along a length of the second elongate surface and is configured to mate with the first edge of the loudspeaker module.

18. The loudspeaker assembly of claim 15, comprising a grille assembly, the grille assembly including a perforated screen and first and second trim members, wherein the first and second trim members are configured to be respectively coupled to the first and second elongate rails, and wherein the perforated screen is configured to be coupled to the first and second trim members.

19. A modular sound component system configured to be located at least partially within a wall, wherein the wall comprises a planar wall surface coupled to substantially vertical studs with corresponding wall cavities between the vertical studs, the modular sound component system comprising:

a rail system configured to contact the wall, wherein the rail system includes first and second linear elongate rails;

a first loudspeaker module comprising a first loudspeaker module face, a first loudspeaker cabinet configured to receive a first loudspeaker, and first and second rail attachment features disposed on opposite side edges of the first loudspeaker module near the first loudspeaker module face; and a second loudspeaker module comprising a second loudspeaker module face, a second loudspeaker cabinet configured to receive a second loudspeaker, and third and fourth rail attachment features disposed on opposite side edges of the second loudspeaker module near the second loudspeaker module face; and a spacer module that includes fifth and sixth rail attachment features and a stud attachment feature;

wherein the first loudspeaker module is configured to be slidably coupled to the first and second rails using the first and second rail attachment features, respectively, to position the first loudspeaker cabinet in a first wall cavity;

wherein the second loudspeaker module is configured to be slidably coupled to the first and second rails using the third and fourth rail attachment features, respectively, to position the second loudspeaker cabinet in a second wall cavity that is spaced apart from the first wall cavity by at least one of the vertical studs; and wherein the spacer module is configured to be slidably coupled to the first and second rails using the fifth and sixth rail attachment features, respectively, and the spacer module is configured to be coupled to the at least one of the vertical studs between the first and second wall cavities.

20. The modular sound component system of claim 19, comprising a communication link that is configured to extend over a wall-side surface of the at least one stud to couple the first and second loudspeaker modules.

* * * * *